United States Patent [19]

Allen

[11] 4,095,805

[45] Jun. 20, 1978

[54] ANNULAR BLOWOUT PREVENTER

[75] Inventor: Herbert Allen, Houston, Tex.

[73] Assignee: Cameron Iron Works, Inc., Houston, Tex.

[21] Appl. No.: 732,802

[22] Filed: Oct. 15, 1976

[51] Int. Cl.[2] ..... E21B 33/06

[52] U.S. Cl. ..... 277/27

[58] Field of Search ..... 277/73, 27; 251/1, 1 A, 251/1 B

[56] References Cited

U.S. PATENT DOCUMENTS

| | | | |
|---|---|---|---|
| 2,812,197 | 11/1957 | Gibson | 277/73 |
| 3,994,472 | 11/1976 | Williams | 251/1 B |

*Primary Examiner*—Robert I. Smith

[57] ABSTRACT

There is disclosed an annular blowout preventer having a packer comprising an annulus of resilient material which is movable from an open bore position to a constricted, closed bore position by means which include links arranged to exert a force on the packer having a radially inwardly directed component which increases with the force required to seal the packer about successively smaller pipes.

11 Claims, 6 Drawing Figures

ANNULAR BLOWOUT PREVENTER

This invention relates to improvements in annular blowout preventers for use in controlling pressure within an oil or gas well during drilling and completion.

A preventer of this type includes a packer which comprises an annulus of resilient material for moving between an open bore position and constricted positions for sealing about a pipe in the bore or upon itself. Since the resistance of the packer to constriction increases as it is constricted, more operating force is required to move the packer into position to seal about a 2 inch pipe than is required to move it into position to seal about a 3 inch pipe. Furthermore, the packer's resistance to constriction, and thus operating force required to seal about smaller pipe, increases rapidly with constriction. At the same time, the packer should not seal so tightly about the pipe as to make it difficult to move or "work" the pipe, as may be required during drilling or completion of the well. Still further, the optimum pressure for sealing the pipe depends on the well pressure to be controlled.

In prior preventers of this type, it has been proposed to so move the packer by an operator comprising a conical piston surfce disposed about an outer conical surface of the annulus, as shown in U.S. Pat. No. 2,609,836, or arcuate segments on the inner ends of radially disposed pistons, as shown in U.S. Pat. No. 3,572,627. In each case, however, the radially inwardly directed forces for constricting the packer are substantially constant. Hence, a constricting force suitable for sealing about a pipe of given diameter may be so large as to seal so tightly about a pipe of larger diameter that the larger pipe cannot be worked.

U.S. Pat. No. 2,812,197 shows an annular preventer in which the operator includes links which are embedded in the upper and lower ends of the annulus and arranged to move the packer to constricted position as the annulus is vertically compressed by a vertically reciprocating piston in the housing of the preventer. Since the links swing toward a more horizontal position, they exert radially inwardly directed forces on the packer which increase during constriction of the packer, and thus with the increased force required to seal about pipes of successively smaller diameters. However, the embedding of the links in the packer annulus may damage the resilient material as the links are moved to and from their more horizontal positions. Also, of course, the packer may not be removed from the preventer housing, for repair or replacement, without also removing the links.

It is therefore the primary object of the present invention to provide an annular blowout preventer wherein links for so moving the packer are so arranged as to not damage the packer, and wherein the packer does not interfere with independent removal of the packer from the preventer housing.

Another object is to provide such a preventer in which the packer is so moved by a force which is assisted by well pressure and, more particularly, wherein the packer is arranged and constructed as to seal about a pipe with a pressure related to the well pressure being controlled.

Yet another object is to provide a preventer which is relatively inexpensive and simple and of a construction which permits simple repair and maintenance.

These and other objects are accomplished, in accordance with the illustrated embodiment of the present invention, by an annular blowout preventer of the type described in which the packer is moved to constricted position by means which includes links which are arranged to exert a force on the packer having a radially inwardly directed component which increases with the force required to seal the packer about successively smaller pipes, but in which the packer is nevertheless separate from the links. Thus, the packer is not susceptible to damage by the links, and is removable from the housing independently thereof. Thus, the links are disposed about the packer within the recess, and the preventer housing includes a portion at one end of the packer recess which is releasably connected to the remainder of the housing so as to permit the packer to be so removed from the housing upon disconnection and removal of such portion from the remainder of the housing.

In the preferred embodiment of the invention, the means for so moving the packer also includes a plurality of plates circumferentially spaced about the packer, and actuating means vertically reciprocable within the recess, the links extending between and engaging the actuating means and plates for swinging toward a more horizontal position, and thus pushing the plates against the packer to force it inwardly to a constricted position, upon movement of the actuating means in one direction. Then, upon movement of the actuating means in the opposite direction, the packer is permitted to move back toward open bore position.

The links are arranged in vertically spaced, parallel pairs, and the means for reciprocating the actuating means includes cylinder means in the body, piston means within the cylinder means and connected to the actuating means, and means for selectively admitting and exhausting pressure operating fluid from and to the cylinder means on opposite sides of the piston means. Preferably, the cylinder means and piston means are annular, and the links extend between and are pivotally connected to the plates and a ring connected to the piston and extending into the cylinder near the outer side of the recess.

Figure 1:
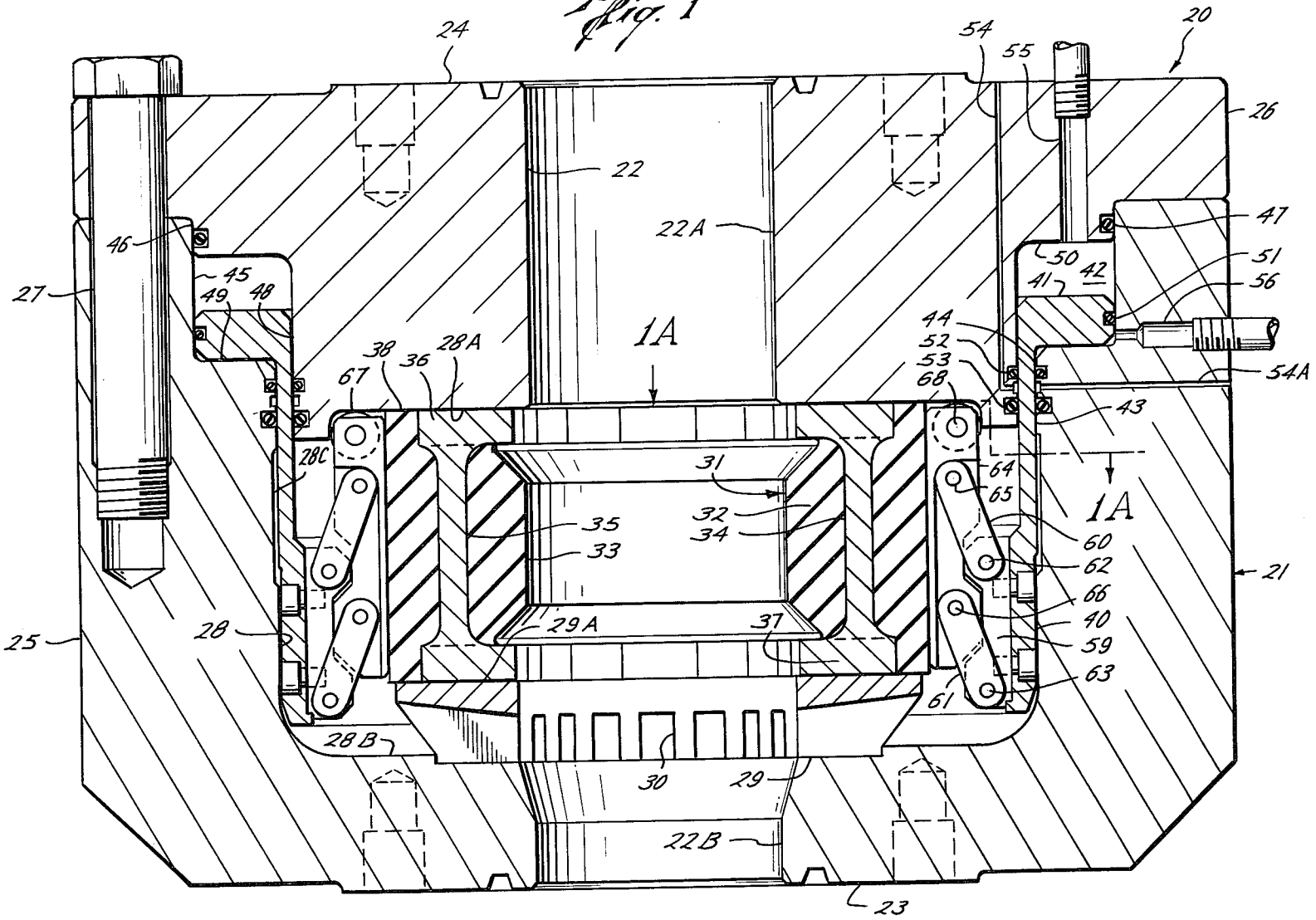
FIG. 1 is a vertical sectional view of an annular blowout preventer constructed in accordance with the present invention, with the packer thereof shown in its open-bore position.

With reference now to the details of the above-described drawings, the overall preventer, which is designated in its entirety by reference character 20, is shown to include a housing 21 having a bore 22 extending vertically therethrough. Suitable means are provided on ends 23 and 24 of the housing for sealably connecting it to other wellhead members. With the preventer 20 so installed in a wellhead, its bore 22 is aligned with the bores of the other wellhead members, and thus with the bore of the well therebelow.

Housing 21 is made up of a lower, generally cup-shaped body 25, and an upper, cap-like body 26 which, when connected to the lower body by means of bolts 27, forms an annular recess 28 about bore 22. Bore 22 has an upper portion 22A formed in upper body 26 and a lower portion 22B formed in lower body 25. Recess 28 has an upper end 28A formed on the lower end of upper body 26, a lower end 28B formed on an upper shelf of lower body 25, and an outer wall 28C on the inner side of the lower body. A bridge 29 is mounted on the lower end 28B of the recess and has ports 30, for a purpose to be described hereinafter.

Figure 2A:
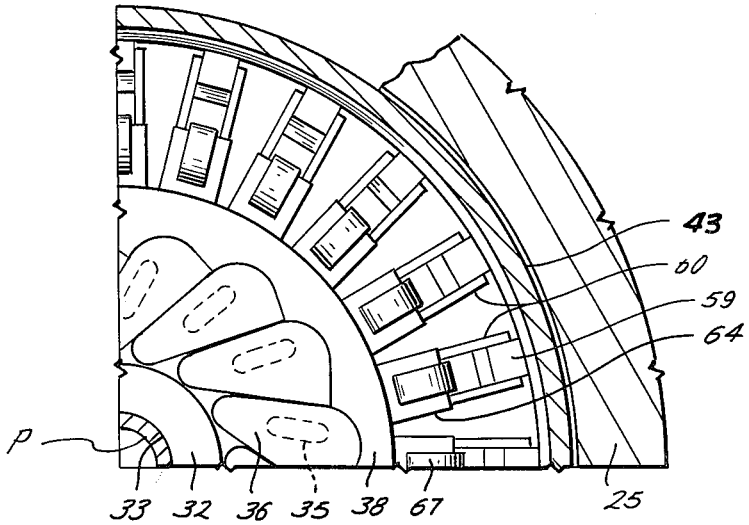
FIG. 2A is a partial sectional view of the preventer, as seen along broken lines 2A—2A of FIG. 2.
Figure 3A:
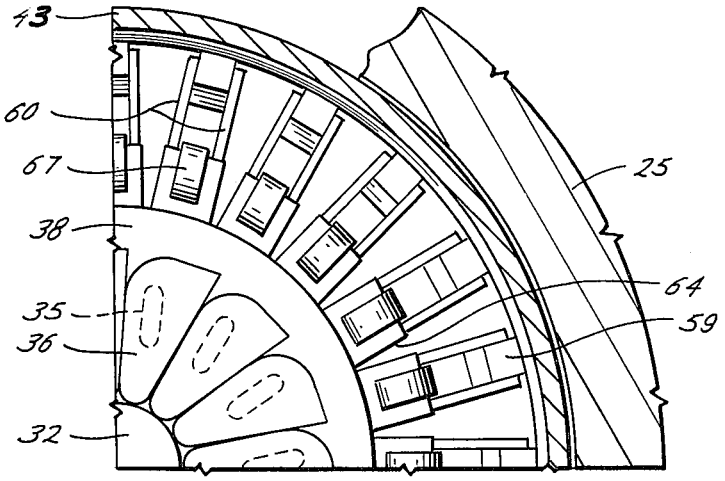
FIG. 3A is a partial sectional view of the preventer, as seen along broken lines 3A—3A of FIG. 3.
Figure 2:
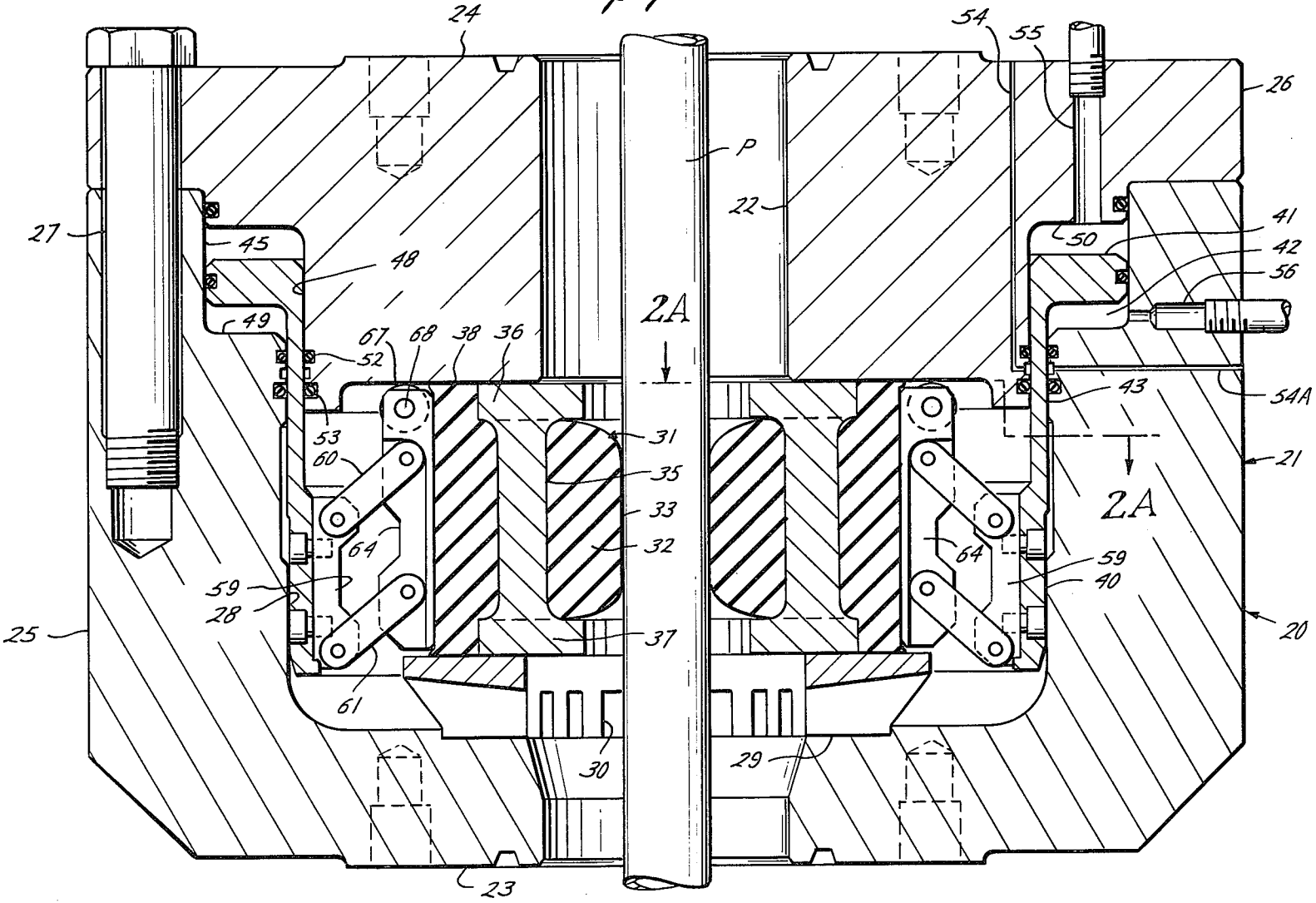
FIG. 2 is a vertical sectional view of the preventer, similar to FIG. 1, but with the packer moved to a constricted position to seal about a pipe.
Figure 3:
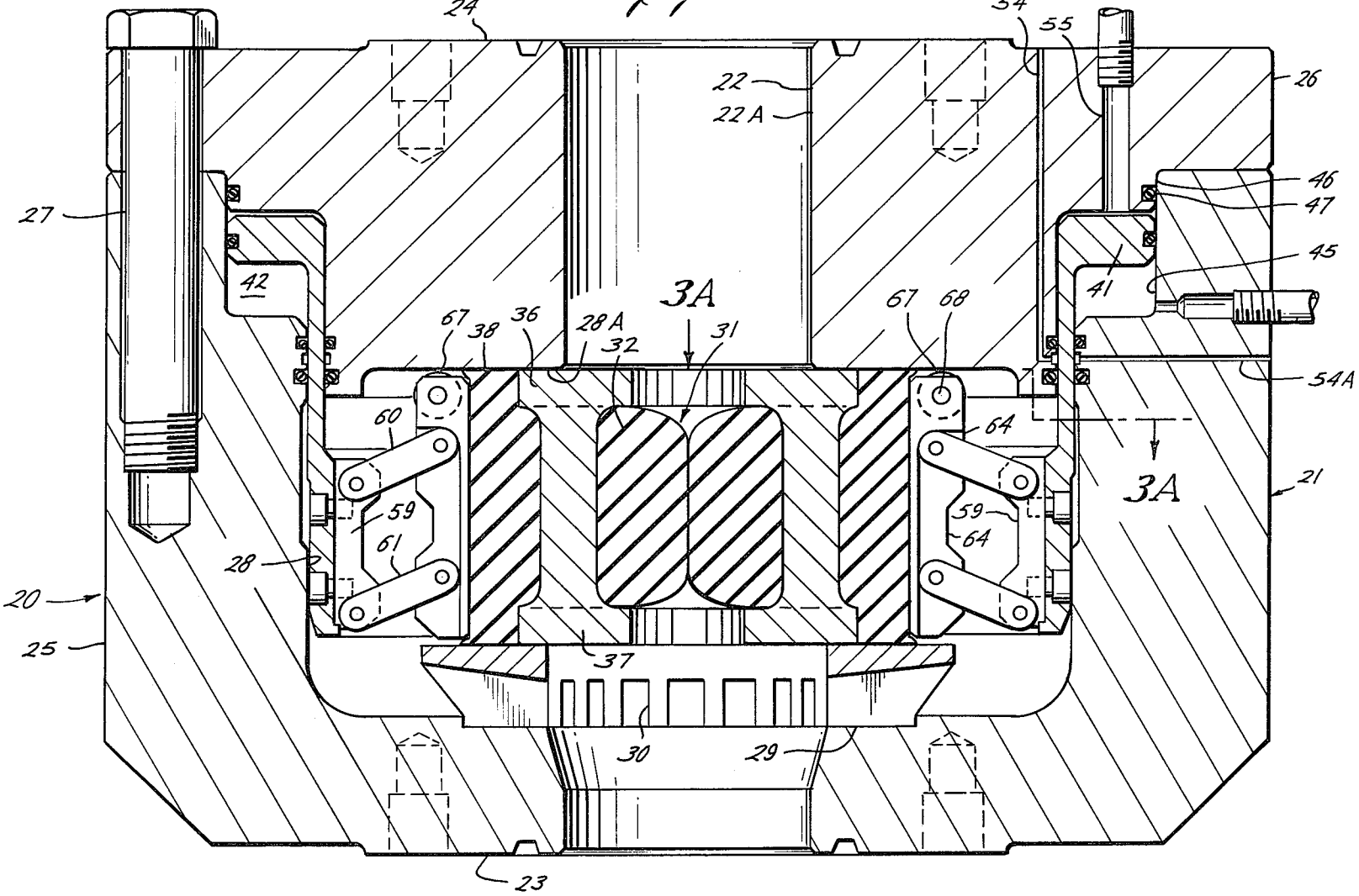
FIG. 3 is a vertical sectional view of the preventer, similar to FIGS. 1 and 2, but with the packer moved to a further constricted position to seal upon itself.

A packer 31 disposed within recess 28 includes an annulus 32 of resilient material which is confined top and bottom by upper end 28A of the recess and an upper surface 29A of bridge 29 for moving between a normal, open-bore position, as shown in FIG. 1, and constricted positions, as shown in FIGS. 2 and 3. In the open-bore positions of the annulus, its inner surface 33 forms a continuation of bore 22. When constricted, the annulus may seal about a pipe P or other object within the well bore, as shown in FIG. 2, or upon itself, as shown in FIG. 3.

Figure 1A:
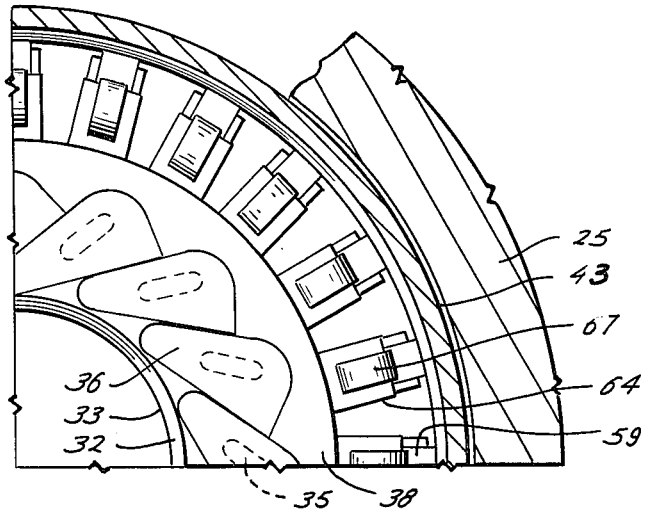
FIG. 1A is a partial sectional view of the preventer, as seen along broken lines 1A—1A of FIG. 1.

As in the packers of the aforementioned U.S. Pat. No. 3,572,627, rigid inserts 34 are imbedded within the annulus 32. Each insert includes a vertical rib 35 having flanges 36 and 37 at its ends which slide on the upper end of the recess and upper surface of the bridge during movement of the packer. The radially outer ends of the flanges terminate inwardly of the outer diameter of the annulus, to provide an annular top surface 38 of the annulus to sealably engage upper end 28A of the recess. As shown in FIGS. 1A, 2A and 3A, flanges 36 and 37 are of a modified triangular shape and are arranged in side-by-side sliding engagement to cause them to swing from the positions shown in FIG. 1A to those in FIGS. 2A and 3A. Thus, elongate ribs 35 of the inserts swing into more radial positions to extend the effective radial lengths of the flanges.

The means by which packer 31 is caused to move between the above-described positions comprises a ring 40 mounted adjacent outer wall 28C of the recess for vertical reciprocation between a lower position, as shown in FIG. 1, an upper position, as shown in FIG. 3, and an intermediate position, as shown in FIG. 2. The ring is caused to move between these positions by an annular piston 41 which is vertically reciprocable within an annular cylinder 42 in housing 21. Thus, ring 40 is integrally connected to a skirt 43 of the piston which extends through an annular passageway 44 in the body connecting cylinder 42 with recess 28.

Cylinder 42 and passageway 44 are formed between oppositely facing surfaces of bodies 26 and 25 of the preventer housing. Lower body 25 has a counterbored portion 45 at its upper end, and upper body 26 has an upper reduced diameter portion 46 on its lower side which fits closely within portion 45 and carries a seal 47 for sealably engaging counterbored portion 45. Upper body 26 also has a lower reduced diameter portion 48 which extends downwardly into an upward continuation of outer wall 28C of recess 28 to form passageway 44 for skirt 43 therebetween.

A shoulder 49 on lower body 25 forms the lower end of cylinder 42, and a shoulder 50 on upper body 26 forms the upper end of the cylinder. A seal ring 51 is carried on piston 41 for sealably engaging the outer side of the cylinder 42 during reciprocation of the piston. Two pairs of seal rings 52 and 53 are carried by portion 48 and the upper extension of outer-recess wall 28C for sealably engaging skirt 43. Passages 54 and 54A vent passageway 44 intermediate seal rings 52 and 53 to prevent leakage from recess 28 into cylinder 42.

A port 55 extends through upper body 26 to the upper end of the cylinder, and a port 56 extends through lower body 25 to the lower end. Thus, operating pressure fluid may be admitted or exhausted to control reciprocation of the piston.

Brackets 59 are connected to the inner side of ring 40 in circumferentially spaced-apart relation, and a pair of spaced links 60 and 61 are connected to the opposite sides of each bracket by pivot pins 62 and 63 for swinging about vertically spaced horizontal axes. The opposite ends of the links are connected by vertically spaced pivot pins 65 and 66 to plates 64 which engage annulus 32 of the packer in circumferentially spaced-apart relation. The links are of equal length and parallel so as to function as a parallelogram to maintain the plates 64 parallel to brackets 59 as the links swing about their pivot points.

When the packer is in the open-bore position of FIG. 1, the links form relatively small acute angles with respect to the vertical, and anti-friction rollers 67 rotatably mounted by pins 68 on the upper ends of plates engage upper end 28A of the recess to prevent upward movement of the inner ends of the links. Consequently, upward movement of piston 41 and thus ring 40 causes the links to swing toward a more horizontal position and thus force plates 64 against the packer to move it to a constricted position. As the links 60 and 61 become progressively more horizontal, the horizontal component of the force they exert on plates 64 increases, so that the force with the annulus seals is greater with smaller pipe in the bore.

Well pressure beneath the annulus has access through ports 30 of bridge 29 to the recess behind the packer to assist in maintaining the annulus sealably engaged with the pipe. Well pressure is also effective over the cross-sectional area of skirt 43 of piston 41 to provide an upwardly directed force which assists in urging the piston and thus the ring 40 in an upward, packer constricting direction. Thus, the annulus is constricted into engagement with the pipe P with a force due to operating fluid admitted through passageway 56, as well as that due to well fluid acting on the packer and on the piston.

In order to close off the open hole with no pipe in the bore of the preventer, piston 41 is moved to its upper position to lift ring 40 further within recess 28. As a result, links 60 and 61 are caused to swing to their most horizontal positions wherein the angle which they form with respect to the vertical plane is at a maximum. Thus, the packer is constricted by a still larger horizontal component of force. Of course, upon lowering of piston 41, packer 31 is free to expand back to its open bore position.

Removal of bolts 27 and body 26 from body 25 permits access to all internal parts for replacement or repair. In particular, lifting of body 26 enables removal of the packer independently of the links and other parts of the operating means for constricting the packer.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the present invention without departing from the scope thereof, it is to be understood that all matter herein set forth or shown in the accompanying drawings is to be interpreted as illustrative and not in a limiting sense.

The invention having been described, what is claimed is:

1. An annular blowout preventer, comprising a housing having a vertical bore therethrough and an annular recess about the bore, a packer comprising an annulus of resilient material mounted within the recess for movement between an open-bore position and a constricted position for sealing about a pipe or upon itself, a plurality of rigid plates circumferentially spaced about the packer, actuating means vertically reciprocable within the recess outwardly of the plates, and links extending between and engaging the actuating means and plates for swinging in vertical planes toward a more horizontal position, and thus moving said plates inwardly to force the packer inwardly to a constricted position, upon movement of the actuating means in one direction, and toward a more vertical position to permit the plates to be moved outwardly and said packer to move toward open-bore position, upon movement of the actuating means in the opposite direction, and means for so reciprocating the actuating means.

2. A preventer of the character defined in claim 1, wherein the links extending between the actuating means and each plate are arranged in vertically spaced, parallel pairs.

3. A preventer of the character defined in claim 1, wherein said means for reciprocating the actuating means includes cylinder means in the body, piston means vertically reciprocable within the cylinder means and connected to the actuating means, and means for selectively admitting and exhausting operating fluid from and to the cylinder means on opposite sides of the piston means.

4. A preventer of the character defined in claim 1, including rollers mounted on the upper ends of the plates for rolling on the upper end of the recess during movement of the packer therein.

5. A preventer of the character defined in claim 1, including means restraining said plates from relative vertical movements as they are moved inwardly against the packer.

6. A preventer of the character defined in claim 1, wherein said packer is separate from the links to permit it to be removed from the housing independently of said links.

7. An annular blowout preventer, comprising a housing having a vertical bore therethrough and an annular recess about the bore, a packer comprising an annulus of resilient material mounted within the recess for movement between an open-bore position and a constricted position for sealing about a pipe or upon itself, the upper end of said packer sealably engaging the upper end of the recess when in a constricted position, and the housing bore below the packer being fluidly connected with the recess on the outer side of the packer, whereby fluid pressure in the bore assists in maintaining the packer in sealing position, a plurality of plates circumferentially spaced about the packer, a ring mounted for vertical reciprocation within the recess outwardly of the plates, a plurality of pairs of vertically spaced, parallel links each extending between and pivotally connected at opposite ends to the ring and to a plate for swinging the links in vertical planes toward a more horizontal position, and thus pushing said plates inwardly against the packer to force it inwardly to a constricted position, upon movement of the rings in one direction, and toward a more vertical position to permit said packer to move toward open-bore position and the plates to be moved outwardly, upon movement of the ring in the opposite direction, and means for so reciprocating the ring.

8. An annular blowout preventer of the character defined in claim 7, wherein said reciprocating means includes an annular cylinder in the body, an annular piston within the cylinder, means connecting the piston to the ring, and means for selectively admitting and exhausting operating fluid to and from the cylinder on opposite sides of the piston.

9. A preventer of the character defined in claim 7 including rollers mounted on the upper ends of the plates for rolling on the upper end of the recess.

10. A preventer of the character defined in claim 7, including means restraining said plates from relative vertical movement as they are moved inwardly against the packer.

11. A preventer of the character defined in claim 7, wherein said packer is separate from the links, and said housing includes a portion at one end of the recess which is releasably connected to the remainder of the housing so as to permit said packer to be removed from the housing independently of the links.

* * * * *